US007388550B2

(12) United States Patent
McLean

(10) Patent No.: US 7,388,550 B2
(45) Date of Patent: Jun. 17, 2008

(54) PXM ANTENNA WITH IMPROVED RADIATION CHARACTERISTICS OVER A BROAD FREQUENCY RANGE

(75) Inventor: James S. McLean, Austin, TX (US)

(73) Assignee: TDK Corporation, Chiba (JP)

( * ) Notice: Subject to any disclaimer, the term of this patent is extended or adjusted under 35 U.S.C. 154(b) by 430 days.

(21) Appl. No.: 11/247,944

(22) Filed: Oct. 11, 2005

(65) Prior Publication Data

US 2007/0080878 A1 Apr. 12, 2007

(51) Int. Cl.

| | |
|---|---|
| ***H01Q 21/00*** | (2006.01) |
| ***H01Q 11/02*** | (2006.01) |
| ***H01Q 13/10*** | (2006.01) |
| ***H01Q 9/38*** | (2006.01) |

(52) U.S. Cl. ..... 343/725; 343/739; 343/767; 343/829

(58) Field of Classification Search ..... 343/725, 343/729, 739, 767, 829, 830

See application file for complete search history.

(56) References Cited

U.S. PATENT DOCUMENTS

| | | | | |
|---|---|---|---|---|
| 2,971,192 | A | | 2/1961 | Clifford et al. |
| 3,710,340 | A | | 1/1973 | Mayes |
| 4,710,775 | A | * | 12/1987 | Coe ..... 343/727 |
| 6,054,955 | A | | 4/2000 | Schlegel, Jr. et al. |
| 6,323,821 | B1 | | 11/2001 | McLean |
| 6,329,955 | B1 | | 12/2001 | McLean et al. |
| 6,424,309 | B1 | | 7/2002 | Johnston et al. |
| 6,483,466 | B2 | | 11/2002 | Liu |

OTHER PUBLICATIONS

Mayes et al., "The Monopole Slot: A Small Broad-Band Unidirectional Antenna," IEEE Transactions on Antennas and Propagation, Jul. 1972, pp. 489-493.

Long, "A Combination of Linear and Slot Antennas for Quasi-Isotropic Coverage," IEEE Transactions on Antennas and Propagation, Jul. 1975, pp. 572-576.

* cited by examiner

*Primary Examiner*—Shih-Chao Chen
(74) *Attorney, Agent, or Firm*—Kevin L. Daffer; Daffer McDaniel, LLP

(57) ABSTRACT

A low-loss, high-efficiency, broadband antenna including both electric and magnetic dipole radiators is provided herein. The broadband antenna may be referred to as a "P×M antenna" and may generally include a ground plane; a magnetic radiator formed within the ground plane; a conductive feed arranged within a first plane, which is parallel to the ground plane; and an electric radiator arranged within a second plane, which is perpendicular to the ground plane and coupled at one end to the conductive feed. According to a particular aspect of the invention, the electric and magnetic radiators are substantially complementary to one another and are coupled for producing a P×M radiation pattern over a broad range of operating frequencies. One advantage of the P×M antenna described herein is that the complementary antenna elements are combined without the use of a lossy, resistive matching network, thereby increasing the efficiency with which the P×M radiation pattern is produced.

39 Claims, 5 Drawing Sheets

PXM ANTENNA WITH IMPROVED RADIATION CHARACTERISTICS OVER A BROAD FREQUENCY RANGE

BACKGROUND OF THE INVENTION

1. Field of the Invention

This invention relates to antennas and, more particularly, to a practical implementation of a low-loss, high-efficiency, broadband antenna incorporating both electric and magnetic radiating components.

2. Description of the Related Art

The following descriptions and examples are not admitted to be prior art by virtue of their inclusion within this section.

A wide operating frequency range is currently used for purposes of communications, especially ultra-wideband (UWB) communications and electromagnetic compatibility (EMC) testing. For example, many commercial and military-based communication devices operate within the 3 MHz to 30 MHz "high frequency" (HF) band, the 30 MHz to 300 MHz "very high frequency" (VHF) band, and in some cases, lower portions of the 300 MHz to 3 GHz "ultra high frequency" (UHF) band. Advantages of these relatively low frequency bands include improved diffraction around and penetration through obstacles, such as walls and foliage, and reduced path loss and attenuation in air, resulting in longer transmission lengths for a given power level. Due to the inverse relationship between size and operating frequency, antenna elements of relatively large size are often used for communicating in relatively low frequency bands, such as the HF and VHF bands. In many cases, however, it may be desirable for the antenna elements to be as small as possible for reasons of convenience, durability, space constraints and/or aesthetics.

Electrically-small antenna elements are utilized in many low frequency (e.g., mobile communications) and high frequency (e.g., EMC testing) applications. For example, an electrically-small antenna may be used in low frequency applications to accommodate space, durability or other concerns, or in high frequency applications to achieve a particular frequency level, which may be desired for EMC testing purposes. As used herein, the term "electrically-small" refers to an antenna or antennal element with relatively small geometrical dimensions when compared to the wavelengths of the electromagnetic fields they radiate. Quantitatively speaking, electrically-small antennas are generally defined as antennas which fit inside a sphere with a radius, $a=\lambda/2\pi$, where $\lambda$ is the wavelength of the electromagnetic energy radiated from the antenna.

Unfortunately, electrically-small antennas tend to have rather large radiation quality factors (Q) meaning that they tend to store (on time average) much more energy than they radiate. This leads to input impedances that are predominantly reactive, which can make it difficult, if not impossible, to impedance match an electrically-small antenna to an input feed over a broad range of bandwidths. Furthermore, due to the large radiation quality factor, the presence of even small resistive losses may lead to very low radiation efficiencies in electrically-small antennas (e.g., around 1-50% efficiency).

According to known quantitative predictions, the minimum attainable radiation Q for any linearly-polarized, electrically-small antenna, which fits inside a spherical volume of radius, a, can be found by:

$$Q = \frac{1}{ka} + \frac{1}{k^3a^3} \quad \text{(EQ. 1)}$$

where $k=1/\lambda$, the wave number associated with the electromagnetic radiation. Thus, the radiation Q of an electrically-small antenna may be roughly proportional to the inverse of its electrical volume (a), or inversely proportional to the antenna bandwidth. In order to achieve relatively broad bandwidth and high efficiency with a single-element, electrically-small antenna of a given size, it may be desirable to utilize as much of the volume (that the antenna occupies) as possible. This may be achieved, in some cases, by increasing the size of the antenna elements, while retaining an electrically-small status.

In order to achieve the fundamental limit on radiation Q, as set forth in EQ. 1, an antenna would have to excite only the Transverse Magnetic ($TM_{01}$) or Transverse Electric ($TE_{01}$) mode outside of the enclosing spherical surface, and store no electric or magnetic energy inside the spherical surface. So while, a short linear (electric) dipole excites the $TM_{01}$ mode outside of the sphere, it does not satisfy the criterion of storing no energy within the sphere, and thus, exhibits a higher radiation Q (and narrower bandwidth) than that predicted by EQ. 1.

In general, all antennas that radiate dipolar fields, such as electric and magnetic dipoles, are limited by the constraint given in EQ. 1. Though some broadband dipole designs have been successfully implemented and approach the limit given in EQ. 1, it is currently impossible to construct a linearly-polarized, omnidirectional antenna that exhibits a radiation Q less than that predicted by EQ. 1. However, while EQ. 1 represents the fundamental limit on the radiation Q of a linearly-polarized, omnidirectional antenna, it is not the global lower limit on radiation Q. Instead, a compound antenna which radiates substantially equal power into the $TM_{01}$ and $TE_{01}$ modes can (in principle) achieve a radiation Q of approximately:

$$Q = \frac{1}{2}\left[\frac{2}{ka} + \frac{1}{k^3a^3}\right] \quad \text{(EQ. 2)}$$

or roughly half that of an isolated electric or magnetic dipole, which radiates the $TM_{01}$ or $TE_{01}$ mode, alone. In other words, the impedance bandwidth of a compound antenna can be nearly double that of an isolated electric or magnetic dipole.

Ideal compound antennas having a pair of infinitesimally-small electric and magnetic dipoles, which are co-located and oriented to provide orthogonal dipole moments, have been theoretically and numerically examined and found to provide useful features. Such antennas are often referred to as "P×M antennas," due to their orthogonal combination of electric (p) and magnetic (m) dipole vectors. Desirable characteristics of P×M antennas may include, but are not limited to, a useful radiation pattern (e.g., a low-gain, unidirectional radiation pattern) and a relatively broad impedance bandwidth for a given electrical size. As noted above, the radiation Q of an electrically-small P×M antenna is approximately half that of an isolated electric or magnetic dipole. Though the reduced Q should improve broadband impedance matching (at least in principle), practical implementations of P×M antennas have been problematic and have not been thoroughly investigated.

SUMMARY OF THE INVENTION

The problems outlined above may be in large part addressed by an improved P×M antenna design that exhibits lower loss, and higher efficiency and operating frequency bandwidth over that provided by conventional P×M antenna designs. The P×M antenna design described herein increases radiation efficiency by eliminating the internal resistive load. Instead of employing an internal load as was done in previous designs, the P×M antenna design described herein improves broadband impedance matching between the electric and magnetic radiators of a P×M antenna by providing the radiators with a tapered, folded and/or end-loaded configuration. Broadband impedance matching may be further improved through the use of a predominantly reactive matching network, if necessary. Various methods for forming an improved P×M antenna are also contemplated herein.

According to a general embodiment, a broadband P×M antenna is provided herein with a ground plane, a magnetic radiator (e.g., a slot antenna) formed within the ground plane, and a conductive feed arranged within a first plane, which is parallel to the ground plane. In order to generate a P×M radiation pattern, an electric radiator (e.g., a monopole antenna) may be arranged within a second plane, which is perpendicular to the ground plane and the magnetic radiator formed therein. The electric radiator may be coupled at one end to the conductive feed, which in turn, may be coupled to the ground plane. In this manner, the electric and magnetic radiators may be generally coupled for producing a P×M radiation pattern over a broad range of operating frequencies. However, unlike conventional designs, the P×M radiation pattern produced by the present invention is maintained over the broad range of operating frequencies without the incorporation of predominantly lossy elements between the conductive feed and the ground plane.

As used herein, a "predominantly lossy" element may be described as any load that introduces a substantial amount of "loss" through resistive, dielectric or magnetic means. In many prior art designs, resistive loads were included between the conductive feed and ground plane to reduce reflections caused by unmatched magnetic and electric radiators. Because resistive loads tend to introduce a significant amount of loss, the prior art designs suffered from highly inefficient operation. A reactive load, on the other hand, introduces substantially no loss, and therefore, may be used for decreasing the difference between the input impedances of the magnetic and electric radiators without decreasing the radiation efficiency of the P×M antenna.

In some cases, the conductive feed may be terminated at one end with one or more predominantly reactive elements arranged to form a reactive matching network. Since reactive loads are relatively lossless, the present invention improves upon prior art designs by avoiding the decreased efficiencies provided by lossy, resistive loads. In one example, the reactive matching network described herein may include one or more lumped elements (i.e., capacitors and inductors), which may be interconnected with lengths of uniform transmission line. A reactive matching network including lumped elements may be implemented for designs intended for low frequency operation. In higher frequency ranges, the reactive matching network may, instead, be implemented with a plurality of open-circuited and short-circuited stubs, which may be interconnected by lengths of uniform transmission line. However, reactive matching networks may not be necessary in all cases, and therefore, may be eliminated from one or more embodiments of the invention, which provide intrinsic broadband impedance matching by manipulating the shape of the magnetic and electric radiators.

In some embodiments, the electric and magnetic radiators may be provided with a tapered configuration for improving input impedance matching for increasing the range of operating frequencies over which the desired P×M radiation pattern is maintained. For example, a shape of the slot antenna may resemble a bow-tie shape, whereas a shape of the monopole antenna may resemble a conical or triangular shape. Alternative shapes are also contemplated for the tapered monopole and slot antennas. Regardless of exact shape, the conductive feed may be formed from a transmission line spaced above the ground plane. To improve impedance matching between the tapered radiators, the transmission line may terminate in a flared section, which may be coupled to the ground plane via one or more predominantly reactive elements. A reactive matching network may or may not be used with the tapered monopole-slot configuration.

In some embodiments, the electric and magnetic radiators may be provided with a folded configuration for improving input impedance matching by increasing an input impedance associated with the electric radiator and decreasing an input impedance associated with the magnetic radiator. Folding also provides intrinsic series-shunt compensation, in that it cancels the antenna reactance or susceptance over a certain frequency range. In one embodiment, the electric and magnetic radiators may be "singly-folded." For example, the monopole antenna may be folded to provide an upward impedance transformation (of about 4), whereas the slot antenna may be folded to provide a downward impedance transformation (of about ¼). In some cases, the slot antenna may be "folded" by etching or cutting a T-shaped opening through the ground plane. A folded monopole antenna, on the other hand, may be formed to include a top portion supported by two equal-length leg portions. The top portion of the monopole antenna may be arranged parallel to the ground plane; the two equal-length leg portions may be arranged parallel to each other and perpendicular to the ground plane. The folded monopole antenna may be formed by bending a strip of conductive material, or assembling multiple strips of conductive material, into the desired folded configuration.

In some embodiments, the singly-folded electric and magnetic radiators may be provided with an end-loaded configuration to further improve input impedance matching and for decreasing a radiation Q and physical height associated with the broadband P×M antenna. For example, the top portion of the monopole antenna may be formed such that opposing ends of the top portion extend beyond the outer surfaces of the two equal-length leg portions of the monopole antenna. Likewise, a pair of additional openings may be formed within the ground plane at opposing ends of a top portion of the T-shaped opening forming the slot antenna. The pair of additional openings may be substantially parallel to each other and substantially perpendicular to the top portion of the 'T'. In the folded and/or end-loaded configurations, the conductive feed may include a transmission line arranged within or slightly above the T-shaped opening, which extends through the ground plane to form the slot antenna.

BRIEF DESCRIPTION OF THE DRAWINGS

Other objects and advantages of the invention will become apparent upon reading the following detailed description and upon reference to the accompanying drawings in which.

Figure 1:
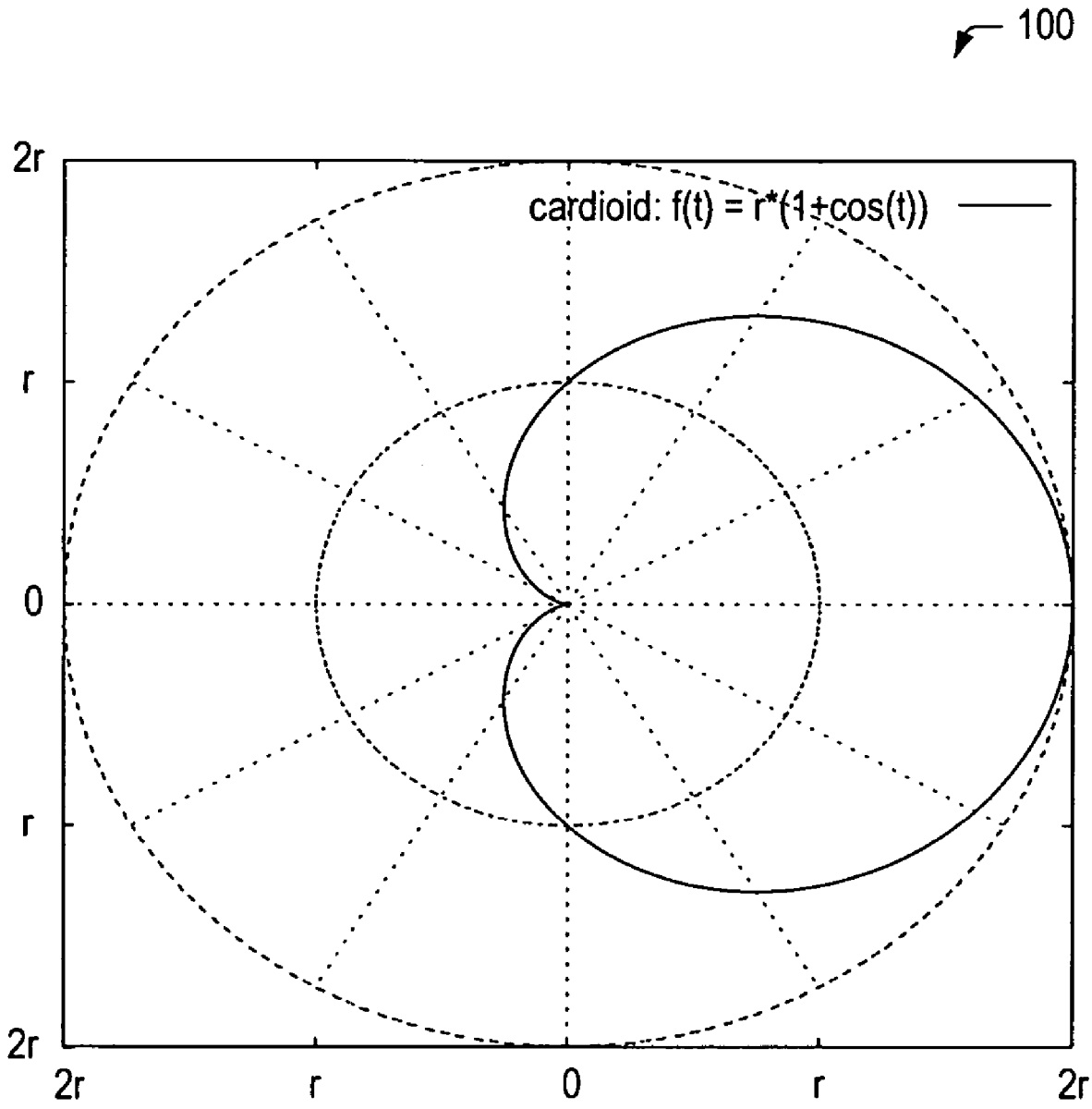
FIG. 1 is a polar plot of an exemplary cardioid-shaped radiation pattern.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

P×M antennas, so called because they are derived from an orthogonal combination of electric and magnetic radiators, possess several desirable characteristics including, but not limited to, a useful radiation pattern and relatively broad impedance bandwidth for a given electrical size. One form of the P×M antenna exhibits the radiation pattern of a hypothetical Huygens source. The radiation pattern, also referred to as the Ludwig-3 pattern, is a linearly-polarized unidirectional pattern comprised of a cardioid of revolution about the axis of maximum radiation intensity, and falls into the class of so-called maximum directivity patterns. As used herein, a "cardioid" is described as the curve traced by a point on the circumference of a circle rolling completely around another circle of fixed radius (r), and has the general equation of:

$$\rho = r^*(1+\cos\theta) \qquad \text{(EQ.3)}$$

in polar coordinates. A polar plot of a cardioid-shaped radiation pattern 100 is shown in FIG. 1. In the foregoing discussion, a cardioid-shaped radiation pattern may be otherwise referred to as a "P×M radiation pattern."

Ideal P×M antennas having a pair of infinitesimally-small, co-located electric and magnetic dipoles oriented to provide orthogonal dipole moments have been theoretically and numerically examined. For example, it has been theorized that an infinitesimally-small magnetic dipole loop can be combined in an orthogonal relationship with an infinitesimally-small electric (wire) dipole to produce an ideal P×M antenna. In the far field region, the electric field of the co-located pair of dipoles may be approximately equal to:

$$E_\theta = \left[\frac{A}{\eta}\sin\theta + B\sin\phi\right]\frac{e^{-jkr}}{r} \qquad \text{(EQ. 4)}$$

and $$E_\phi = B[\cos\theta\cos\phi]\frac{e^{-jkr}}{r} \qquad \text{(EQ. 5)}$$

where A and B are weighting coefficients of the $TM_{01}$ and $TE_{11}$ modes, respectively, and r, θ and ϕ constitute a standard right-hand spherical coordinate system. If A=ηB, then the directional gain of the antenna may be given by the equation:

$$G(\theta,\phi) = \frac{3[(\sin\theta+\sin\phi)^2+\cos^2\theta\cos^2\phi]}{4} \qquad \text{(EQ. 6)}$$

When the above equation is plotted in polar coordinates, a cardioid-shaped radiation pattern is produced in the θ=90 and ϕ=90 planes with a maximum gain of approximately 3.0 dB (or 4.77 dBi) also occurring in those planes. The 3.0 dB maximum gain is over that provided by an isolated electric or magnetic dipole. Therefore, it would appear that infinitesimally-small electric and magnetic dipoles may be combined (at least in theory) to produce a radiator with roughly half the radiation Q and as much as 3 dB more gain than produced by an isolated dipole.

However, though the co-located pair of infinitesimally-small electric and magnetic dipoles has been shown to possess many valuable attributes (e.g., a low-gain, unidirectional radiation pattern), it is not a practical radiator. First, true co-location is generally impossible when finite-sized elements are used. Second, for an antenna to achieve significantly broad bandwidth (e.g., multiple octaves), it may be necessary for the antenna to be electrically-small at the lower end of its operating frequency range, but only slightly so. Electrically-small antennas are described herein as having an electrical volume with a radius of approximately λ/2π. This is significantly larger than the radius of an "infinitesimally-small" radiator, which may be on the order of λ/100, or smaller. Therefore, unless the individual radiators have some appreciable electrical size, while still remaining electrically-small, broadband operation is simply not possible with the theorized radiator.

In order to provide broadband operation, the dipole moments of the electric and magnetic radiators must be substantially orthogonal in spatial orientation, and substantially equal in magnitude and phase over the operating frequency range. It is not difficult to specify the relationship between the magnitude and phase of two isolated electric and magnetic radiators in a numerical or analytical model. In practice, however, such an antenna is usually driven from a single radio-frequency (RF) source, whose finite output impedance must be matched to the input impedances of the combined electric and magnetic radiators. This tends to be a particularly difficult problem due to the resonant nature of the combined electric and magnetic radiators.

In some cases, a low-loss, passive feed or matching network may be used to combine the electric and magnetic radiators. However, such matching networks are often difficult to implement, due to the frequency-dependent variation in the input impedance of the two radiators. For example, variations in input impedance can make it difficult to maintain the proper magnitude and phase of the feed currents supplied to the electric and magnetic radiators. Furthermore, even when a matching network is used to combine the radiators, residual impedance mismatches may still limit the efficiency and power transfer of the antenna/matching network, and thus, the overall efficiency of the system. Although possible matching networks have been suggested, none of the currently known designs allow the combined radiator to operate efficiently over a broad range of frequencies. Therefore, the use of such designs often negates any improvements in bandwidth that may be provided by the lower radiation Q of the P×M radiator.

In principle, broadband P×M operation should be possible by combining electric and magnetic radiators with complementary input impedances. For example, a slot antenna may be the "complement" of an electric monopole (or dipole) antenna with similar dimensions as the slot antenna. According to Babinet's principle, the radiation pattern of a slot antenna in an infinitely large conducting sheet is the same as that of a complementary monopole (or dipole) antenna, except that the electric and magnetic fields are interchanged. Furthermore, the input impedances of a slot antenna and its complementary monopole are related by Booker's equation:

$$Z_{slot}Z_{monopole} = \frac{\eta^2}{4} \quad \text{(EQ. 7)}$$

where $Z_{slot}$ and $Z_{monopole}$ are the input impedances of the slot and monopole antenna, respectively, and $\eta$ is the intrinsic impedance of the surrounding medium (e.g., $\eta=120\pi$ in free space). In other words, the input impedances of complementary antenna elements are roughly inversely proportional to one another. Therefore, when the complementary antenna elements are combined to form a single radiating structure, the complementary input impedances may be cancelled or reduced to achieve a relatively matched input impedance over a wide range of frequencies.

Though it has been suggested that complementary electric and magnetic radiators may be combined to form a single radiating structure, the present inventor is unaware of any previously known antenna designs, which can maintain a P×M radiation pattern (i.e., a low-gain, unidirectional, cardioid-shaped pattern) over a broad range of frequencies (up to, e.g., 1:5 frequency transformation) with high efficiency (e.g., about 85 to 100%). Exemplary embodiments of an improved P×M antenna design are described below and illustrated in FIGS. 2-4.

FIG. 2 illustrates an exemplary antenna 200 that incorporates both electric and magnetic radiators, according to one embodiment of the invention. As described in more detail below, P×M antenna 200 demonstrates one manner in which a practical, low-loss (i.e., high-efficiency), broadband P×M antenna design may be implemented. Other implementations and/or variations are possible and within the scope of the invention. In the following discussion, exemplary broadband electric and magnetic radiators will be investigated, followed by an exemplary means for combining the two radiative elements, such that P×M operation is maintained over a broad frequency range.

Figure 2A:
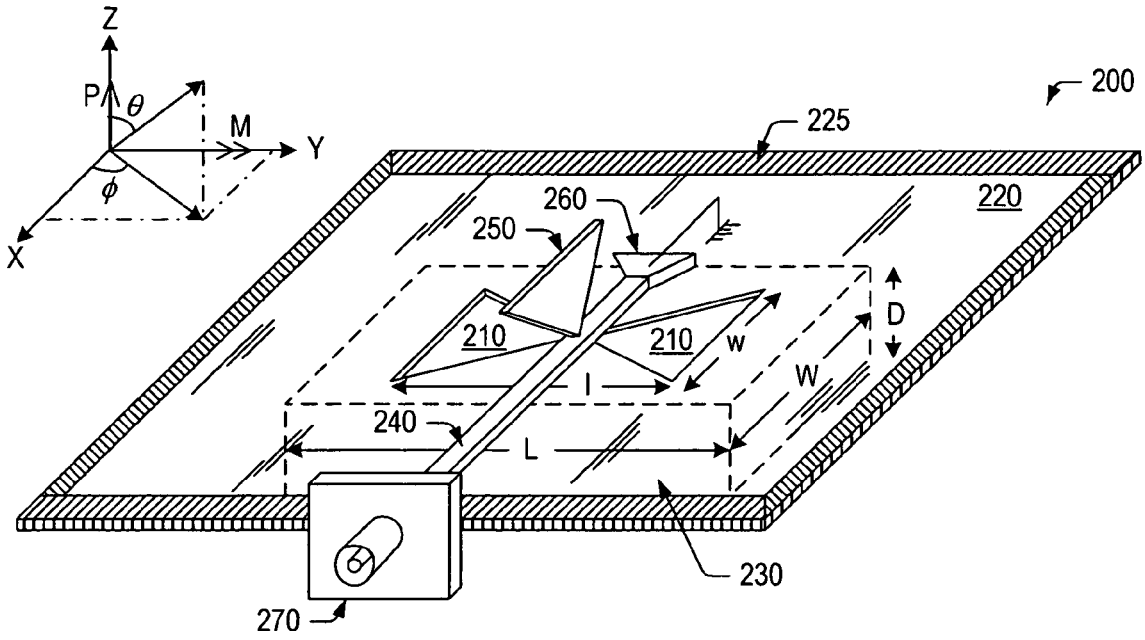
FIG. 2A is a three-dimensional view of a P×M antenna incorporating a tapered monopole-slot configuration, according to one embodiment of the invention.

As shown in FIG. 2A, P×M antenna 200 generally includes a slot 210, which is cut or otherwise formed within a conductive ground plane 220, a conductive feed 240 arranged above and parallel to ground plane 220, and an electric monopole 250, which may be electrically connected at its lower end to conductive feed 240. To enable P×M operation, slot 210 and monopole 250 are arranged in perpendicular planes, so as to produce orthogonal magnetic and electric dipole moments. In some embodiments, a cavity structure 230 with conductive sidewalls and bottom surface may be positioned underneath ground plane 220 surrounding slot 210. The cavity structure 230 may be attached by any appropriate means to a lower surface of ground plane 220, such that portions of the ground plane surrounding the slot form a top surface of cavity 230. However, cavity structure 230 may not be included in all embodiments of the invention. For example, the slot radiator could be alternatively realized by placing magnetic material (e.g., anisotropic hexagonal ferrites) directly on the ground plane. This would eliminate the need for a physical slot and cavity backing.

Ground plane 220 may be formed to include a relatively large (compared to the wavelength of radiated energy), relatively flat conductive surface. In some cases, ground plane 220 may be formed by depositing a metal layer onto a semiconductor substrate using one of many semiconductor fabrication techniques (e.g., CVD, PVD, electroplating, etc.). As such, ground plane 220 may form part (or all) of a printed circuit board fixedly attached within an electronic device, or a removable card configured for insertion within the electronic device (e.g., any portable or non-portable consumer device, such as laptop or desktop computers, hand-helds, DVD players, etc.). In other cases, however, ground plane 220 may be cut or formed from a metal layer, which may or may not form part of a larger structure (such as, e.g., a vehicle or aircraft). Possible materials that may be used to form ground plane 220 include substantially any "good" electrical conductor including, but not limited to, copper, aluminum and gold, or any alloy thereof. In some cases, a multi-layer metal-dielectric structure, such as copper clad PTFE, FR-4 or LTCC, could be used to form ground plane 220. Such a multi-layer structure may be desirable because of the mechanical advantages provided by the laminate construction and the lithography. Alternative methods and materials that may be used to fabricate ground plane 220 are possible and included within the scope of the invention.

Figure 2B:
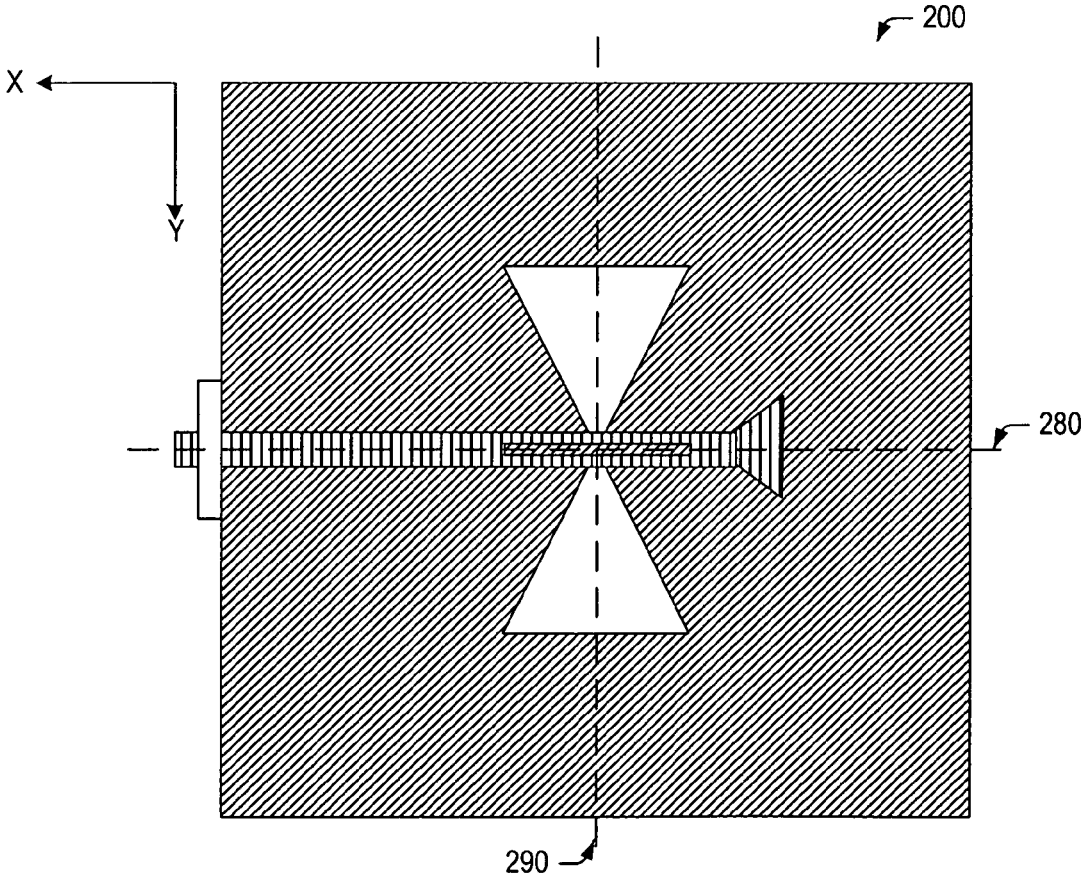
FIG. 2B is a top-side two-dimensional view of the P×M antenna of FIG. 2A.

Regardless of fabrication methodology, ground plane 220 is bound by a finite boundary. This boundary may be substantially rectangular in shape, as depicted in FIGS. 2A and 2B. However, ground plane 220 should not be limited to the illustrated shape, but instead, should be considered to include substantially any shape (e.g., circular, oval, polygonal, etc.) within which a slot radiator may be formed. In some embodiments, radiative diffraction along the edges of ground plane 220 may be reduced by selecting a ground plane shape that includes substantially no sharp corners. For example, ground plane 220 may be formed with rounded corners, or smoothly contoured edges, to reduce the electrical discontinuities (and therefore, the radiative diffractions) that typically occur at sharp corners and edges.

In an ideal embodiment, ground plane 220 would be infinitely large, so that edge effects would not disturb the radiation pattern produced by slot 210. In reality, however, the finite extent of ground plane 220 introduces a radiation null in the plane within which it lies. This null can be made narrow if diffraction from the edges of ground plane 220 is reduced or eliminated. In addition to rounding corners and/or smoothly contouring edges, ground plane diffraction can be reduced by "treating" the edges of the ground plane. For example, the edges of the ground plane may be treated with a lossy, magnetic material 225 to reduce edge diffractions. In other words, diffraction can be reduced or eliminated by treating the edges with a material that reduces current flow along the edges. Suitable materials include ferrite-based materials; however, substantially any other lossy, magnetic material may be used. In other cases, the ground plane could be formed to include a tapered resitivity, or in other words, a resitivity that increases in the vicinity of the ground plane edges. For example, the ground plane could undergo a surface treatment that consists, e.g., of bombarding the ground plane edges with ions to reduce or destroy the conductivity of the ground plane at the edges. Other techniques may be used to remove ground plane material at the edges (e.g., by etching or cutting "notches" into the ground plane) to increase the resitivity at the ground plane edges.

Figure 3A:
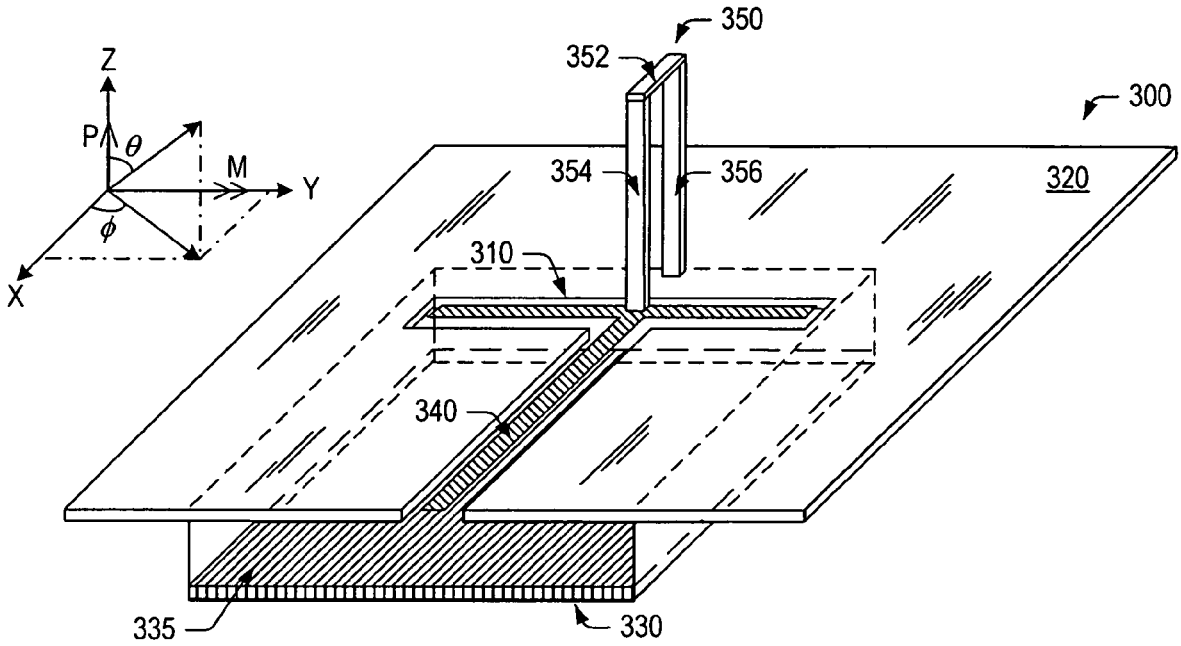
FIG. 3A is a three-dimensional view of a P×M antenna incorporating a folded monopole-slot configuration, according to one embodiment of the invention.

In the embodiment of FIG. 2A, cavity structure 230 is depicted as substantially rectangular in shape. Alternative shapes not shown in the figures may also be possible. In general, the dimensions of cavity structure 230 may be chosen to sufficiently "box-in" slot 210. For example, the length (L) and width (W) of cavity 230 may be substantially greater than or equal to the length (l) and width (w) of slot 210. The depth of cavity 230, on the other hand, may be configured to block radiation from the back-side surface of antenna 200, so that radiation in the forward direction is enhanced. For example, the depth (D) of the cavity structure may be approximately equal to one-quarter of the wavelength of electromagnetic energy radiated from antenna 200; however, smaller or larger cavity depths may be used when deemed appropriate. In some cases, cavity structure 230 may be coated, lined or even partially filled with a magnetic material to improve the radiation patterns of the antenna elements and to isolate them from other electronic components, which may be nearby. In one embodiment, cavity structure 230 may be coated with a ferrite-based material. In a more specific embodiment, cavity structure 230 may be at least partially filled with anisotropic hexagonal ferrites to improve radiation characteristics at higher frequency ranges. One example of a coated cavity structure 330/335 is shown in FIG. 3A.

Conductive feed 240 may be suspended or supported a spaced distance (h) above and parallel to ground plane 210. In most cases, the distance 'h' may be relatively small (compared to the wavelength of radiated energy), albeit sufficient to electrically isolate conductive feed 240 from the ground plane. As shown in FIGS. 2A and 2B, conductive feed 240 may be relatively centered above slot 210 and may extend in a direction, which is substantially perpendicular to the length (l) of slot 210. As described in more detail below, such an arrangement is generally necessary to produce a symmetric P×M radiation pattern.

In the embodiment shown, conductive feed 240 comprises a microstrip line; however, alternative transmission media may be used in other embodiments of the invention. The microstrip line may be formed from a comparatively thin, rectangular-shaped strip of conductive material, which is terminated at one end with a predominantly reactive load 260. In FIGS. 2A and 2B, the reactive load is shown as a flared section of microstrip line (either attached or formed integral with conductive feed 240), which is electrically coupled to ground plane 220 through a reactive matching network (not shown). The significance of reactive load 260 will be discussed in more detail below, along with additional means for implementing a reactive load or reactive load network. In some cases, input connector 270 may be coupled to the other end of conductive feed 240 for establishing an electrical connection with an external transmission line (e.g., a coaxial cable) and supplying current to the conductive feed. However, input connector 270 may be eliminated, in other embodiments of the invention, by connecting the external transmission line directly to the conductive feed.

Electric monopole 250 is connected at its lower end to conductive feed 240, and may be generally positioned near center-lines 280 and 290, which extend along the axial length of conductive feed 240 and slot 210, respectively. In the embodiment of FIGS. 2A and 2B, electric monopole 250 is a tapered monopole formed from a comparatively thin sheet of conductive material. Substantially any electrically conductive material including metal layers (e.g., copper, silver, aluminum, etc) or metal-dielectric laminates (e.g., copper clad PTFE) may be used to form electric monopole 250. In general, the tapered configuration of monopole 250 may improve the broadband performance of the electric radiator by increasing the range of frequencies over which the desired radiation pattern is maintained. Tapering may also improve impedance matching by reducing the antenna radiation Q and discriminating against higher order resonances. Other tapered-configurations may be used to implement monopole 250 in alternative embodiments of the invention. For example, a substantially solid or hollow cone-shaped monopole could be formed from a sheet of conductive material or wire mesh.

In general, tapered monopole 250 should be combined with a magnetic radiator, which is as close to complementary as possible. Therefore, even though slot antenna 210 may be formed with one of several different shapes, slot antenna 210 may also be tapered (e.g., with a bi-triangular or "bow-tie" shape) to provide a complementary radiator to the tapered monopole used in FIGS. 2A and 2B. When ground plane 220 is present, the tapered slot may perform similar to that of the tapered monopole (e.g., each radiator may provide approximately 2 octaves of impedance bandwidth). However, when the radiation pattern of either component antenna (the electric or magnetic radiator) deviates from its ideal characteristics (shape, polarization, etc.), the pattern of the combined P×M antenna may also deviate from the ideal. Therefore, it is generally desired that the component antennas individually behave like electric and magnetic radiators to the extent that it is possible.

To maintain a P×M radiation pattern over a broad range of frequencies, the dipole moments of the electric and magnetic radiators must be substantially orthogonal in spatial orientation, and substantially equal in magnitude and phase over the broad frequency range. When the component radiators themselves behave correctly—like electric and magnetic dipoles—the magnitude and phase of each radiator will be properly oriented to provide the desired performance in the far field. In other words, the elementary electric dipole pattern alone exhibits a defined phase center; that is, the phase of the radiation pattern at a given frequency is substantially constant with direction. The same is true for the elementary magnetic dipole. However, a radiation pattern composed of a combination of these two patterns will exhibit a constant phase pattern only if the far field patterns of the elements are also combined in phase.

The present invention recognizes several improvements that enable a P×M radiation pattern to be maintained with high efficiency over a broad frequency range. First of all, and as noted above, conductive feed 240 may be terminated with a reactive load 260, instead of the predominantly lossy loads commonly used in other prior art designs. As described herein, a "predominantly lossy" load may be any load that introduces "loss" through resistive, dielectric or magnetic means. In the past, many prior art designs included resistive loads between the feed and ground plane to reduce the reflections caused by unmatched component radiators. Because resistive loads introduce a significant amount of loss, the prior art designs suffered from highly inefficient operation. A reactive load, on the other hand, introduces substantially no loss. Therefore, the present invention improves upon prior art designs by using a reactive termination for maintaining the electric and magnetic dipole moments in the proper magnitude and phase relationship without suffering the decreased efficiencies provided by lossy, resistive loads.

However, it is worth noting that the resistive loads of prior art designs cannot simply be replaced with reactive loads without potentially destroying the sought-after P×M radiation pattern. In order to maintain the desired pattern, the component radiators and (optional) reactive matching network described herein must be carefully designed with respect to one another. For example, the component radiators may each be formed with tapered, folded and/or end loaded configurations, each of which may perform an intrinsic broadband impedance transformation on the input impedances of the component radiators. As described in more detail below, the input impedances of the electric and magnetic radiators may be closely matched to each other, and to the input impedance of the conductive feed, by utilizing one or more of the above-mentioned configurations (with or without an additional reactive matching network).

In the embodiment of FIGS. 2A and 2B, reactive load 260 comprises a flared or tapered section of microstrip line with a reactive network coupled between the microstrip line and ground plane 220 at the far end. The reactive network may consist of substantially any number of reactive elements; specific embodiments of which are described in more detail below. Though the reactive network may provide sufficient matching in some embodiments of the invention, the flared or tapered section of microstrip line may be used to provide an additional parameter with which to set the reactive behavior of load 260. For example, the degree of flaring or tapering may be adjusted, in some cases, to alter the reactive behavior of load 260.

Although not illustrated in the drawings for purposes of brevity, reactive load 260 may include a number of different reactive matching networks, depending on the desired operating frequency range and electrical size of the antenna. For example, a reactive matching network can easily be implemented with lumped elements (i.e., capacitors and/or inductors) at relatively low frequencies, such as audio and low radio frequencies. As such, lumped elements may be used when the antenna is of appreciable electrical size. However, it becomes much more difficult to produce "good" capacitors and inductors in the UHF and microwave ranges without making the devices very small, and hence, very lossy. Therefore, so-called distributed matching networks may be used in antenna designs with substantially smaller electrical size to avoid the high power dissipation of small lumped devices in the higher frequency ranges.

In one embodiment, a distributed matching network may comprise open and short circuited stubs, which are interconnected via lengths of uniform transmission line. Like capacitors and inductors, open and short circuited stubs are "reactive elements," or elements that are capable of storing energy, either in the form of electric (i.e., capacitive) or magnetic (i.e., inductive) energy. A "stub" is generally known in the art to be a section of transmission line. For matching purposes, a stub is usually open- or short-circuited at one end to produce a one-port reactive circuit element. The input impedance of an idealized short circuited stub is purely imaginary (i.e., reactive) and positive over the frequency range in which it is less than one-quarter wavelength long. The idealized open circuit stub is the complement of the short circuited stub, and therefore, exhibits an input impedance that is purely imaginary and negative over the frequency range in which it is less than one-quarter wavelength long. When connected via lengths of uniform transmission line, the open and short circuited stubs can be used to implement nearly any filter or impedance matching network topology. In some embodiments, flared or tapered sections of transmission line may be combined with tapered stubs to further refine the distributed matching network.

Figure 3B:
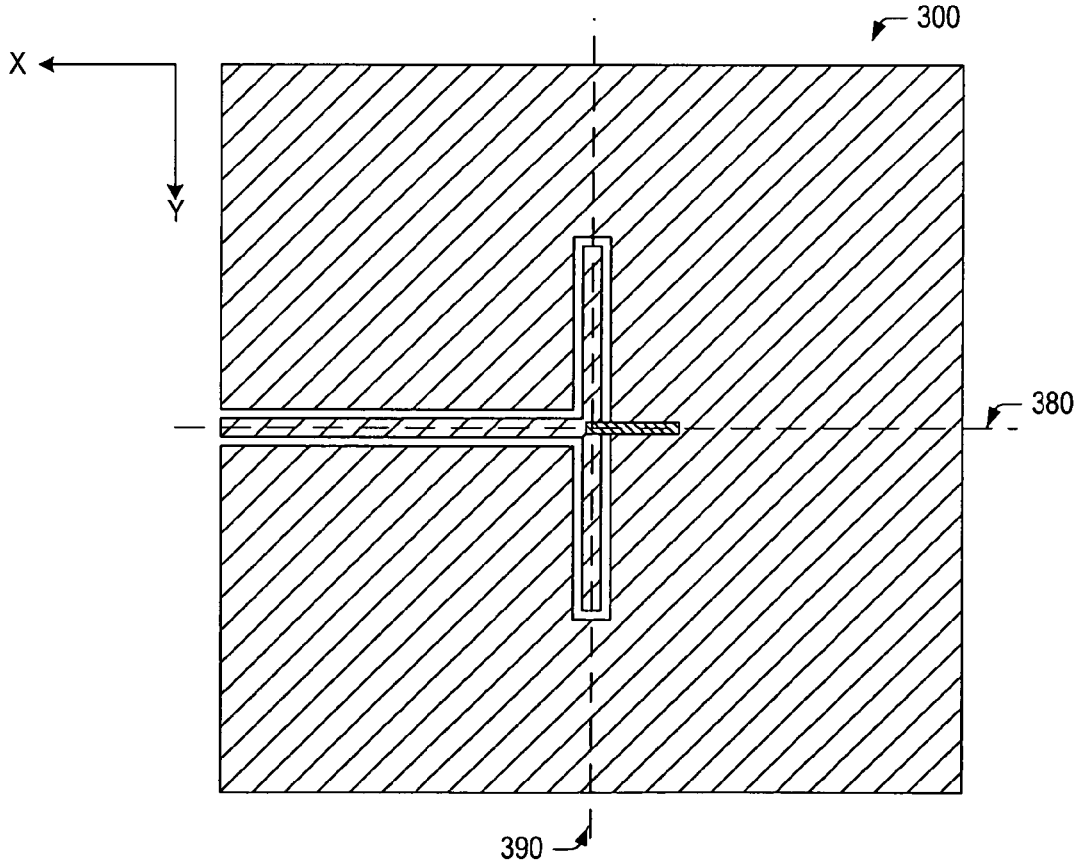
FIG. 3B is a top-side two-dimensional view of the P×M antenna of FIG. 3A.
Figure 4A:
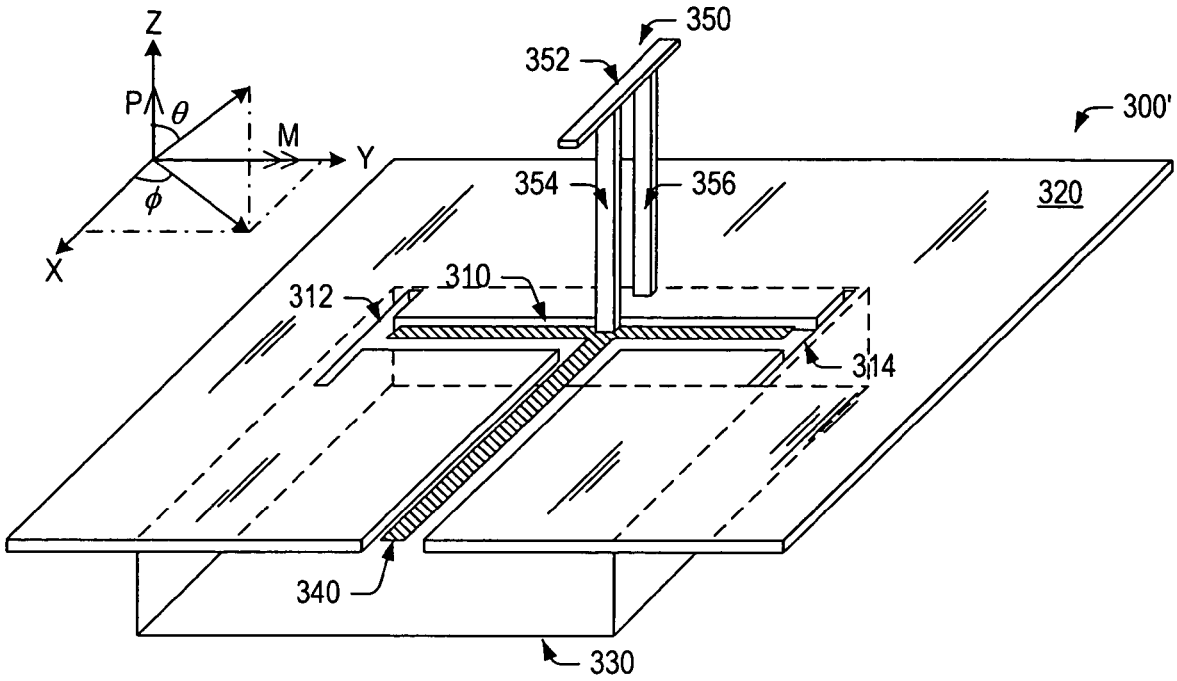
FIG. 4A is a three-dimensional view of a P×M antenna incorporating an end-loaded and folded monopole-slot configuration, according to one embodiment of the invention.
Figure 4B:
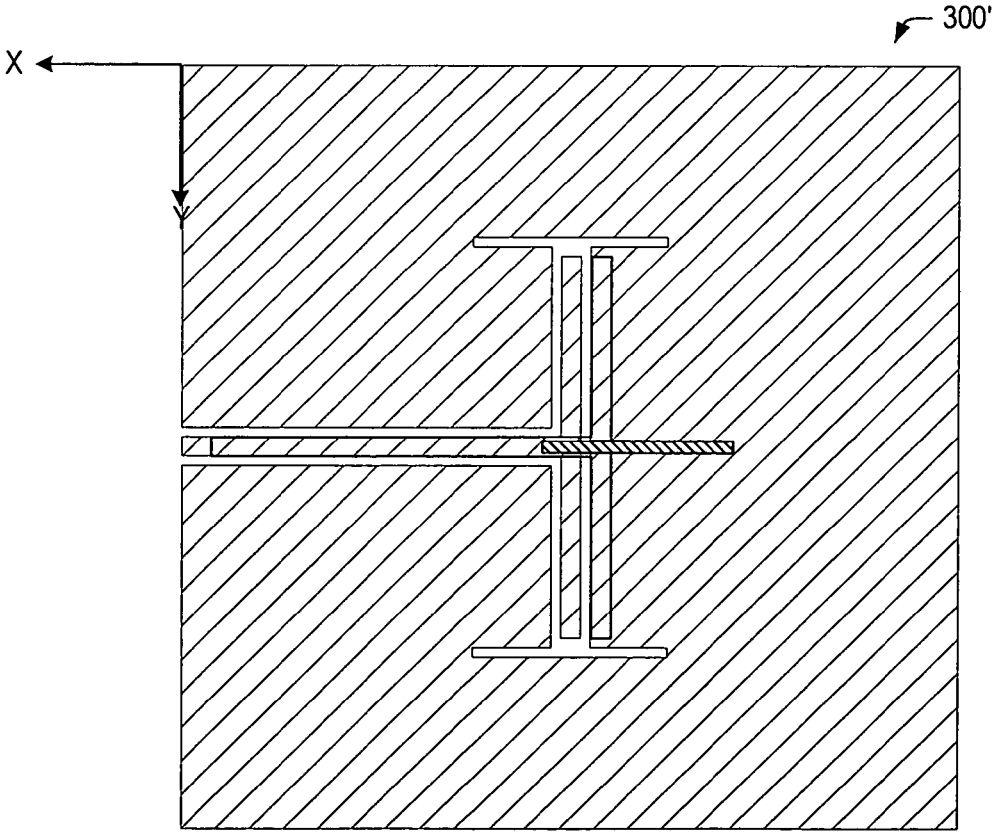
FIG. 4B is a top-side two-dimensional view of the P×M antenna of FIG. 4A.

Other techniques may be used to help maintain the desired P×M radiation pattern over the broad frequency range. For example, the monopole and slot antennas may comprise a folded configuration to improve input impedance matching and simplify the reactive matching network. One embodiment of a folded monopole-slot configuration 300 is shown in FIGS. 3A and 3B. In addition to folding, the monopole and slot antennas may be end-loaded to improve input impedance matching and increase the range over which the P×M pattern is maintained. Therefore, a folded, end-loaded monopole-slot configuration 300' is shown in FIGS. 4A and 4B, in accordance with another embodiment of the invention. Along with the benefits provided by folding and end-loading, the foregoing discussion provides an exemplary manner in which P×M antennas 300 and 300' may be constructed; however, alternative means of construction not disclosed herein may also be possible.

To facilitate broadband impedance matching, the input impedances of the monopole and slot antennas must be relatively well matched to each other, as well as the transmission media supplying current thereto, over the operating frequency range. Most transmission media have characteristic impedances that fall within a relatively small range of values (typically about 1 to 200 Ω). For example, a coaxial transmission line may have a characteristic impedance of about 50 Ω. In addition, transmission lines with very high characteristic impedances or very low characteristic impedances are often difficult to realize, and are either lossy or do not guide energy well. Thus, it is useful for an antenna to exhibit an input impedance that lies within the relatively small range of values described above, so that it can be matched to the transmission media supplying power to the antenna. Numerous means currently exist for transforming impedance levels. However, it is often difficult to implement impedance matching over broad bandwidths.

The slot antenna, in particular, may be relatively difficult to impedance match with a standard coaxial transmission line. For example, Booker's equation (EQ. 7) shows that the input impedances of monopole and slot antennas are roughly inversely proportional to one another. Thus, if an idealized dipole impedance at resonance is about 75 Ω, the idealized slot impedance will be approximately 473 Ω. This may be particularly difficult to match into when the system impedance is near 50 Ω. However, folding can be used to provide an intrinsic broadband impedance transformation for one or more of the antenna elements. For the monopole antenna, folding provides an upward transformation, whereas folding of the slot provides a downward transformation. In one embodiment, a singly-folded slot may be used to provide an input impedance that is approximately ¼ the idealized slot impedance—or about 120 Ω. On the other hand, the input impedance of a singly-folded monopole is approximately 4 times the input impedance (roughly 37.5 Ω) of a quarter-wave monopole—or about 150 Ω. Therefore, the combined input impedance of a singly-folded monopole in shunt with a singly-folded slot (approximately 67 Ω) provides a fairly good match to 50 Ω.

FIGS. 3 and 4 illustrate various embodiments in which a singly-folded monopole can be combined with a singly-folded slot to form broadband P×M antenna 300. Similar to the P×M antenna design of FIG. 2, P×M antenna 300 may generally include a slot 310, which is cut or otherwise formed within a conductive ground plane 320, a conductive feed 340 arranged parallel to ground plane 320, and an electric monopole 350, which may be electrically connected at one end to conductive feed 340. In some embodiments, cavity structure 330 may be positioned underneath ground plane 320 surrounding slot 310. If included, cavity structure 330 may be configured similar to cavity structure 230 of FIGS. 2A and 2B. As noted above, however, cavity structure 330 may not be included in all embodiments of the invention.

Ground plane 320 may be configured similar to ground plane 220, and therefore, may include a relatively large (compared to the wavelength of radiated energy), relatively flat conductive surface. Numerous techniqes may be used to form ground plane 320 including, but not limited to, CVD, PVD, electroplating, molding, cutting, etc. In addition, the finite boundary of ground plane 320 may be formed according to a variety of shapes (e.g., rectangular, circular, oval, polygonal, etc.). To reduce radiative diffraction along the boundary, ground plane 320 may be formed with rounded corners or smoothly contoured edges. In some cases, the edges of ground plane 320 may also be treated (with e.g., a lossy, magnetic material or tapered resitivity) to further reduce radiative diffraction.

Unlike antenna 200, however, slot 310 and monopole 350 may each be formed with a folded configuration, which may enable the input impedances of the electric and magnetic radiators to be more closely matched to each other and to a system impedance (typically around 50 Ω). In the embodiments shown, slot 310 and monopole 350 are considered to be "singly-folded," even though there appear to be multiple bends or folds in the design. As noted above, the singly-folded slot provides a downward impedance transformation (approximately ¼), whereas the singly-folded monopole provides an upward impedance transformation (approximately 4). Though a greater or lesser number of "folds" may be used in other embodiments of the invention, the singly-folded monopole-slot configuration of FIGS. 3 and 4 was found to be relatively well matched to the standard system impedance when the monopole antenna is placed in shunt with the slot antenna.

In the embodiment of FIGS. 3A and 3B, the singly-folded slot 310 includes a substantially "T-shaped" opening formed within ground plane 320. In most cases, the T-shaped opening may have a top portion, which is substantially equal in length to the bottom portion of the T. In some cases, the substantially T-shaped opening may be formed by etching or cutting the opening within the ground plane, such that a bottom portion of the T bisects a top portion of the T at an angle close to 90°. However, it may not be necessary to form the T-shaped opening with perpendicular leg and top portions, in all embodiments of the invention. For example, the opening may be formed in a somewhat slanted-T shape, such that an angle between the leg and top portions is substantially less than or greater than 90°. In some cases, other predominantly symmetric shapes may be used to form slot 310 in alternative embodiments of the invention.

A conductive feed 340 may be arranged within or suspended slightly above slot 310 in a plane parallel to ground plane 320. Though conductive feed 340 is shown in FIGS. 3A and 3B as having substantially the same shape as slot 310, alternative embodiments of the invention may include a conductive feed with a substantially different shape than that used to form slot 310. In the embodiment shown, conductive feed 340 is a coplanar waveguide formed from a relatively thin layer of conductive material (e.g., a metal or metal-dielectric layer). In addition, the coplanar waveguide is arranged within slot 310, so that a top surface of the waveguide is substantially coplanar with a top surface of ground plane 320. To avoid shorting the feed to the ground plane, coplanar waveguide 340 may be formed with slightly smaller dimensions than slot 310, so that the waveguide does not come in contact with the ground plane. Though not shown in the figures, coplanar waveguide 340 may be energized by an external transmission medium attached directly (e.g., by soldering) or indirectly (e.g., via an input connector) to the waveguide. In other embodiments of the invention, waveguide 340 may be suspended somewhat above slot 310, thereby eliminating the need for waveguide 340 to be slightly smaller than slot 310.

In the embodiment of FIGS. 3A and 3B, the singly-folded monopole 350 includes a top portion 352, which is arranged parallel to ground plane 320 and supported by two equal-length leg portions 354 and 356. The equal-length leg portions are arranged substantially parallel to each other and perpendicular to the ground plane. As shown in FIG. 3B, leg portion 354 may be coupled to conductive feed 340 above a center point produced by bisecting lines 380 and 390. Although leg portion 354 may be offset from this center point, in other embodiments of the invention, it is generally preferred that the antenna elements be as symmetrical as possible in both form and arrangement. In other words, substantial deviation from a symmetrical antenna design may undesirably detract from the sought-after P×M radiation pattern.

In some cases, the top and leg portions of monopole 350 may be separately fabricated from strips of conductive material and assembled together through various means (e.g., soldering, adhesives, etc.). In other cases, however, a single strip of conductive material may be folded with two substantially 90° bends to form the top and equal-length leg portions. However, since the main feature of a "folded" antenna is the parallel arrangement of it's conductors, the exact geometry of the bends can be substantially greater or less than 90°. In addition to providing an intrinsic broadband impedance transformation, the act of folding may provide at least some reactive compensation.

As noted above, the singly-folded monopole-slot configuration may be relatively well matched to a standard system impedance when the antenna elements are placed in parallel, or in shunt, with one another. For example, and as shown in FIG. 3A, one of the equal-length leg portions (354) may be electrically coupled to the center conductor of the coplanar waveguide (340), while the other equal-length leg portion (356) is electrically coupled to the ground plane (320). In this manner, reactive matching may be provided by the folded antenna elements, themselves. For example, folding intrinsically enables the antenna elements to store energy, and therefore, may be used to provide enough reactive compensation, so that additional reactive matching network(s) are not needed. In cases where folding, alone, is insufficient, a lumped or distributed matching network may be coupled between monopole 350 and ground plane 320 to provide additional reactive matching.

FIGS. 4A and 4B show an end-loaded, singly-folded monopole-slot configuration 300' in accordance with another embodiment of the invention. In the embodiment shown, slot 310 and monopole 350 are both end-loaded to improve broadband radiation characteristics. Though only one radiator may be end-loaded in other embodiments of the invention, it is generally preferred that the slot and the monopole antennas be as close to complementary as possible. As described below, end-loading may be used to increase the frequency range over which the P×M radiation pattern is maintained, as well as to improve impedance matching between the monopole and slot antennas. In addition, the act of end-loading may reduce the physical height of monopole 350, thereby making it easier to incorporate within tight spaces (which may be found, e.g., in many portable communication devices).

In some cases, monopole antenna 350 may be end-loaded by extending the opposing ends of top portion 356 beyond the outer surfaces of leg portions 352 and 354. In addition, slot antenna 310 may be end-loaded by cutting or forming an additional pair of openings 312 and 314 within ground plane 320. As shown in FIGS. 4A and 4B, the pair of additional openings may be formed within the ground plane at opposing ends of the T-shaped slot. In some cases, the pair of additional openings may be rectangular shaped openings, which are substantially parallel to each other and substantially perpendicular to a top portion of the T. Alternative shapes may be used to form the pair of additional openings, however, it is generally preferred that the shapes be chosen to maintain a symmetrical antenna design.

Practical implementations of a low-loss, broadband P×M antenna have been presented herein. The P×M antenna designs described above provide about 2 octaves of operating bandwidth over which the antenna is approximately 90% efficient, or better. One advantage of the P×M antenna designs described herein is that complementary antenna elements are combined without the use of lossy (e.g., resistive) matching networks. Instead, various combinations of tapered, folded and end-loaded configurations may be used with (or without) additional reactive matching to maintain the desired P×M radiation pattern over the broad frequency range. Unlike prior art designs, antenna efficiency is also maintained over frequency, along with the desired shape (i.e., a cardiod) and level (i.e., about 4.77 dBi gain) of the P×M radiation pattern.

Figure 5:
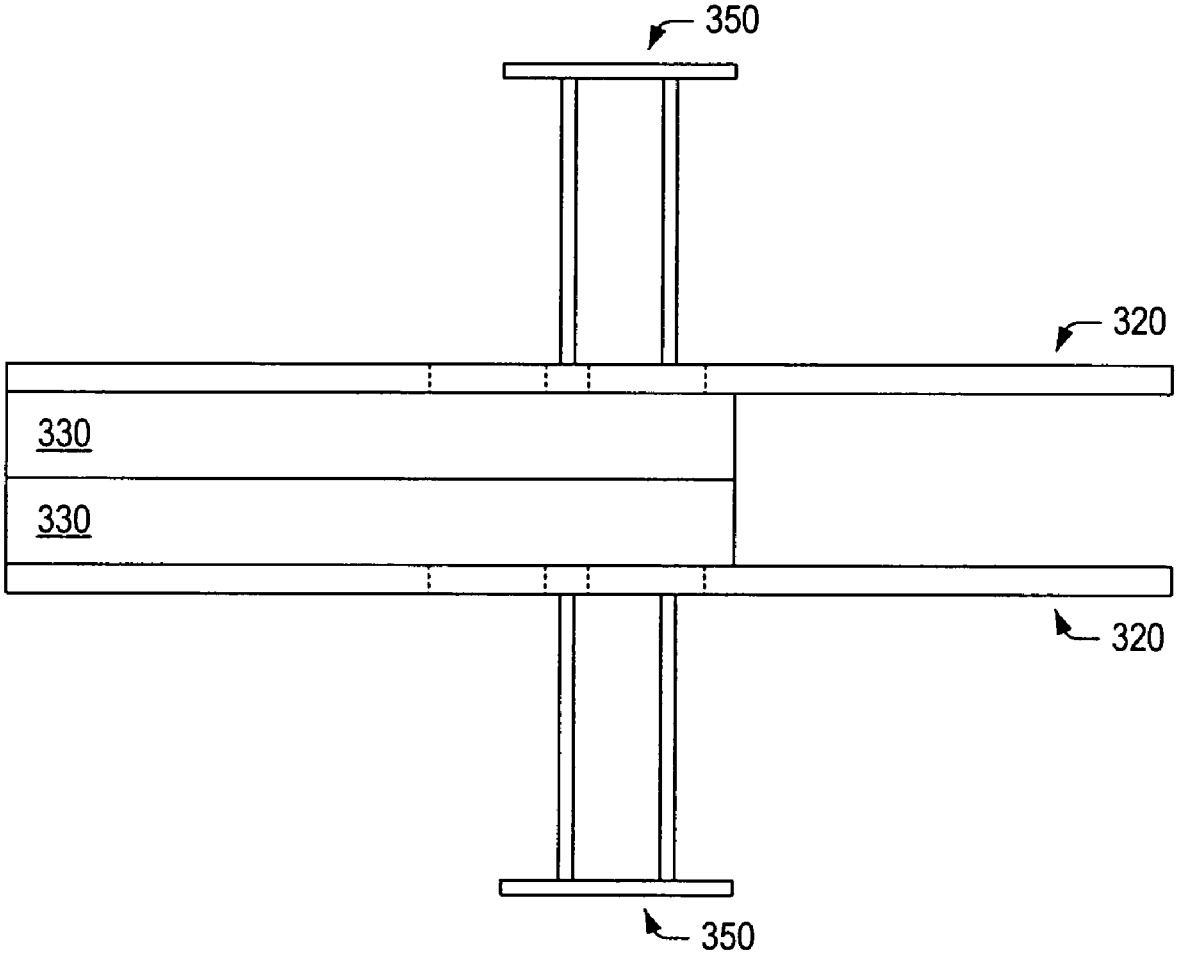
FIG. 5 is a side view of a back-to-back monopole-slot P×M antenna design.

As noted above, the finite extent of the ground plane necessarily introduces a radiation null in the P×M radiation pattern. According to another embodiment of the invention, this radiation null can be eliminated by constructing a P×M antenna with two cavity-backed monopole-slot designs placed back-to-back and driven out of phase with one another. Such an embodiment is depicted in FIG. 5. When the two monopole-slot designs are driven by a balanced source, such as a 180° hybrid network, the resulting antenna design should be very nearly isotropic (i.e., should be able to transmit and receive in substantially any direction). Any one of the monopole-slot configurations described above may be used for this purpose.

It will be appreciated to those skilled in the art having the benefit of this disclosure that this invention is believed to provide a practical implementation of a low-loss, broadband P×M antenna. Further modifications and alternative embodiments of various aspects of the invention will be apparent to those skilled in the art in view of this description. It is intended that the following claims be interpreted to embrace all such modifications and changes and, accordingly, the specification and drawings are to be regarded in an illustrative rather than a restrictive sense

What is claimed is:

1. A broadband antenna, comprising:

a ground plane;

a magnetic radiator formed within the ground plane;

a conductive feed arranged within a first plane, which is parallel to the ground plane;

an electric radiator arranged within a second plane, which is perpendicular to the ground plane, and coupled at one end to the conductive feed;

wherein the electric and magnetic radiators are coupled for producing a P×M radiation pattern over a range of operating frequencies, and wherein no predominantly lossy elements are coupled between the conductive feed and the ground plane.

2. The broadband antenna as recited in claim 1, wherein the electric and magnetic radiators produce electric and magnetic dipole moments, respectively, when excited by the conductive feed, and wherein the electric and magnetic radiators are configured such that the electric and magnetic dipole moments remain substantially orthogonal in spatial orientation and substantially equal in magnitude and phase over an entirety of the range of operating frequencies for producing the P×M radiation pattern.

3. The broadband antenna as recited in claim 2, wherein the range of frequencies comprise a bandwidth ratio of about 1:n, and where n is selected from a range of values between about 2 to about 5.

4. The broadband antenna as recited in claim 2, wherein the range of frequencies comprise about 3 GHz to about 11 GHz.

5. The broadband antenna as recited in claim 2, wherein the magnetic radiator comprises a slot antenna and the electric radiator comprises a monopole antenna.

6. The broadband antenna as recited in claim 5, wherein the conductive feed is terminated at one end with one or more predominantly reactive elements.

7. The broadband antenna as recited in claim 6, wherein the one or more predominantly reactive elements comprise a plurality of open-circuited and short-circuited stubs interconnected by lengths of uniform transmission line.

8. The broadband antenna as recited in claim 6, wherein the one or more predominantly reactive elements comprise one or more capacitors and inductors interconnected by lengths of uniform transmission line.

9. The broadband antenna as recited in claim 5, wherein the conductive feed comprises a transmission line spaced above the ground plane, and wherein one end of the transmission line comprises a flared section that is coupled to the ground plane.

10. The broadband antenna as recited in claim 9, wherein a shape of the slot antenna is selected from a group comprising a rectangular shape and a bow-tie shape.

11. The broadband antenna as recited in claim 9, wherein a shape of the monopole antenna is selected from a group comprising a cylindrical shape, a conical shape, and a triangular shape.

12. The broadband antenna as recited in claim 9, wherein at least one of the electric and magnetic radiators comprises a tapered configuration for increasing the range of operating frequencies over which the P×M radiation pattern is maintained and for improving input impedance matching between the electric and magnetic radiators.

13. The broadband antenna as recited in claim 5, wherein the conductive feed comprises a transmission line arranged within or slightly above one or more openings, which extend through the ground plane to form the slot antenna.

14. The broadband antenna as recited in claim 13, wherein the slot antenna comprises a "T" shape.

15. The broadband antenna as recited in claim 13, wherein the monopole antenna comprises a top portion arranged parallel to the ground plane and supported by two equal-length leg portions, which are arranged parallel to each other and perpendicular to the ground plane.

16. The broadband antenna as recited in claim 15, wherein a first one of the equal-length leg portions is electrically coupled at one end to the transmission line, while a second one of the equal-length leg portions is electrically coupled at one end to the ground plane.

17. The broadband antenna as recited in claim 16, wherein the electric and magnetic radiators each comprise a folded configuration for increasing an input impedance associated with the electric radiator and decreasing an input impedance associated with the magnetic radiator.

18. The broadband antenna as recited in claim 17, wherein at least one of the electric and magnetic radiators comprises an end-loaded configuration for decreasing a radiation Q and physical height associated with the broadband antenna, as well as for decreasing a difference between the input impedances associated with the electric and magnetic radiators.

19. A broadband antenna configured for generating a P×M radiation pattern over a broad range of frequencies, wherein the broadband antenna comprises:

a ground plane;

a slot antenna comprising a T-shaped aperture formed within the ground plane;

a monopole antenna comprising a top portion, which is parallel to the ground plane and supported by two substantially parallel leg portions, which are perpendicular to the ground plane; and wherein the monopole and slot antennas are indirectly coupled for generating the P×M radiation pattern over the broad range of frequencies.

20. The broadband antenna as recited in claim 19, further comprising a conductive feed arranged within or slightly above the T-shaped aperture so that it does not come in electrical contact with surfaces of the T-shaped aperture.

21. The broadband antenna as recited in claim 20, wherein one of the substantially parallel leg portions of the monopole antenna is electrically coupled at one end to the conductive feed, while another one of the substantially parallel leg portions is electrically coupled at one end to the ground plane.

22. The broadband antenna as recited in claim 21, wherein an input impedance associated with the monopole antenna is close to an input impedance associated with the slot antenna.

23. The broadband antenna as recited in claim 22, further comprising one or more predominantly reactive elements coupled to form a reactive matching network and arranged between the conductive feed and the ground plane.

24. The broadband antenna as recited in claim 22, wherein the top portion of the monopole antenna comprises a pair of opposing ends, each of which extend beyond an outer surface of a different one of the substantially parallel leg portions of the monopole antenna.

25. The broadband antenna as recited in claim 24, wherein the T-shaped aperture of the slot antenna comprises a pair of additional openings formed within the ground plane at opposing ends of a top portion of the T, wherein the pair of additional openings are substantially parallel to each other and substantially perpendicular to the top portion of the T.

26. The broadband antenna as recited in claim 22, wherein the ground plane comprises a metal layer formed upon a dielectric layer, and wherein the T-shaped aperture extends through an entire thickness of the metal and dielectric layers.

27. The broadband antenna as recited in claim 26, wherein the ground plane comprises a printed circuit board fixedly attached within an electronic device, or a removable card configured for insertion within the electronic device.

28. The broadband antenna as recited in claim 27, wherein the ground plane comprises a finite boundary, which is treated with a lossy, magnetic material for reducing current flow and radiative diffraction along the finite boundary.

29. The broadband antenna as recited in claim 27, wherein the ground plane comprises a finite boundary, which is treated with a tapered resitivity for reducing current flow and radiative diffraction along the finite boundary.

30. The broadband antenna as recited in claim 26, further comprising a cavity structure coupled to a bottom surface of the dielectric layer so as to enclose the T-shaped aperture on one side of the ground plane.

31. The broadband antenna as recited in claim 30, wherein one or more inner surfaces of the cavity structure are covered with a lossy, magnetic material for reducing radiative emissions from the one side of the ground plane.

32. The broadband antenna as recited in claim 30, further comprising:

a second ground plane;

a second slot antenna comprising a T-shaped aperture formed within the second ground plane;

a second monopole antenna also comprising a top portion, which is parallel to the second ground plane and supported by two substantially parallel leg portions, which are perpendicular to the second ground plane; and a second cavity structure coupled to a bottom surface of the second ground plane, wherein a back-side surface of the second cavity structure is coupled to a back-side surface of the first cavity structure to produce a back-to-back broadband antenna that does not exhibit a radiation null in a vicinity of the ground plane.

33. A method of forming a P×M antenna, said method comprising:

forming at least one aperture within a ground plane;

arranging a conductive feed either within, or suspended slightly above, the at least one aperture;

forming a monopole antenna within a plane, which is orthogonal to the ground plane, and attaching one end of the monopole antenna to the conductive feed;

indirectly coupling the monopole antenna to the at least one aperture, such that when energized by the conductive feed, a magnetic dipole moment generated by the monopole antenna interacts with an electric dipole moment generated by the at least one aperture to create a P×M radiation pattern; and wherein the steps of forming the monopole antenna and the at least one aperture enable the P×M radiation pattern to be maintained over a broad frequency range without coupling any predominantly lossy elements between the conductive feed and the ground plane.

34. The method as recited in claim 33, wherein the steps of forming comprise forming the monopole antenna and the at least one aperture, such that each include at least one substantially 90° angle therein.

35. The method as recited in claim 33, wherein the step of forming the at least one aperture comprises etching or cutting a substantially T-shaped opening within the ground plane, such that a bottom portion of the T bisects a top portion of the T at an angle close to 90°.

36. The method as recited in claim 35, wherein the step of forming the at least one aperture further comprises etching or cutting a pair of additional openings within the ground plane at opposing ends of the top portion of the T, wherein the pair of additional openings are substantially parallel to each other and substantially perpendicular to the top portion of the T.

37. The method as recited in claim 33, wherein the step of forming the monopole antenna comprises bending a strip of conductive material at least twice, so as to form a top portion supported by two equal-length leg portions, wherein the top portion is parallel to the ground plane, and wherein the two equal-length leg portions are parallel to each other and connect to the top portion at angles near 90°.

38. The method as recited in claim 33, wherein the step of forming the monopole antenna comprises assembling a plurality of conductive material strips together, so as to form a top portion supported by two equal-length leg portions, wherein the top portion is parallel to the ground plane, and wherein the two equal-length leg portions are parallel to each other and connect to the top portion at angles near 90°.

39. The method as recited in claim 38, wherein the step of forming the monopole antenna further comprises attaching the plurality of conductive material strips together, such that opposing ends of the top portion extend beyond an outer surface of a different one of the equal-length leg portions.

* * * * *